US011482389B2

(12) United States Patent
Kesarkar et al.

(10) Patent No.: US 11,482,389 B2
(45) Date of Patent: Oct. 25, 2022

(54) NEUTRAL POSITION LIMIT SWITCH HEAD DESIGN WITH PART REDUCTION AND IMPROVED RELIABILITY

(71) Applicant: Eaton Intelligent Power Limited, Dublin (IE)

(72) Inventors: Shailesh Sadashiv Kesarkar, Salcete Goa (IN); Anthony Edward Develice, Mukilteo, WA (US)

(73) Assignee: Eaton Intelligent Power Limited, Dublin (IE)

( * ) Notice: Subject to any disclaimer, the term of this patent is extended or adjusted under 35 U.S.C. 154(b) by 82 days.

(21) Appl. No.: 16/519,250

(22) Filed: Jul. 23, 2019

(65) Prior Publication Data

US 2020/0035427 A1 Jan. 30, 2020

Related U.S. Application Data

(60) Provisional application No. 62/703,624, filed on Jul. 26, 2018.

(51) Int. Cl.
*H01H 3/42* (2006.01)
*H01H 21/28* (2006.01)

(52) U.S. Cl.
CPC ..... *H01H 21/285* (2013.01); *H01H 3/42* (2013.01)

(58) Field of Classification Search
None
See application file for complete search history.

(56) References Cited

U.S. PATENT DOCUMENTS

| | | | | | |
|---|---|---|---|---|---|
| 2,390,365 | A | | 12/1945 | Goff | |
| 3,512,422 | A | | 5/1970 | Aslan | |
| 3,649,785 | A | | 3/1972 | Dietrich | |
| 3,749,860 | A | | 7/1973 | Crepeau | |
| 3,983,343 | A | | 9/1976 | Duncan | |
| 4,242,548 | A | * | 12/1980 | Atsumi | H01H 21/285 200/47 |
| 4,406,933 | A | * | 9/1983 | Boozer | H01H 21/285 200/336 |
| 5,028,748 | A | * | 7/1991 | Sakamoto | H01H 21/285 200/47 |
| 2014/0374224 | A1 | * | 12/2014 | Takahashi | H01H 3/46 200/47 |

* cited by examiner

*Primary Examiner* — Felix O Figueroa
(74) *Attorney, Agent, or Firm* — DiBerardino McGovern IP Group LLC

(57) ABSTRACT

A limit switch operating head includes a shaft rotatable in clockwise and counter-clockwise directions, a cam member supported on the shaft and that is rotatable in the clockwise and counter-clockwise directions responsive to rotation of the shaft, and a follower actuated by the cam member responsive to rotation thereof, with the follower including a pivot pin, a lever portion pivotable about the pivot pin, and a rolling pin mounted to the lever portion and in contact with the cam member. An actuator member contacts the lever portion and translates linearly in a first direction or second direction responsive to pivoting thereof. The rolling pin moves along a profile of the cam member upon rotation of the cam member so as to cause the lever portion to pivot, with the actuator member linearly translating in the first direction or the second direction responsive to the pivoting of the lever portion.

22 Claims, 6 Drawing Sheets

NEUTRAL POSITION LIMIT SWITCH HEAD DESIGN WITH PART REDUCTION AND IMPROVED RELIABILITY

CROSS REFERENCE TO RELATED APPLICATION

The present invention claims priority to U.S. Provisional Patent Application Ser. No. 62/703,624, filed Jul. 26, 2018, the disclosure of which is incorporated herein by reference in its entirety.

BACKGROUND OF THE INVENTION

The present invention relates generally to limit switches and, more particularly, to a neutral position limit switch that includes a simplified head assembly design with less moving parts therein.

Electrical limit switches comprise a widely employed class of switching apparatus for selectively completing and/or interrupting one or more electrical connections depending upon the position of a displaceable switch-sensing member. Many electrical limit switches include a head assembly that incorporates a rotary actuator that translates rotary motion into a linear motion to actuate the limit switch. A typical head assembly has a crank or other lever for rotating an actuator shaft, and an output member driven by the actuator shaft with linear output movement. The output member engages and drives an element of the displaceable switch-sensing member for selectively completing and/or interrupting one or more electrical connections. In some embodiments, the electrical limit switch may be constructed as a neutral position switch where the actuator shaft of the head assembly is rotatable in both clockwise and counter-clockwise directions for effecting movement of the output member and a corresponding translation of the displaceable switch-sensing member from a neutral position to two distinct positions in different modes.

It is recognized, however, that presently constructed head assemblies of the above described design possess certain disadvantages as far as their operating characteristics and construction are concerned. For example, neutral position limit switches where the actuator shaft of the head assembly is rotatable in both clockwise and counterclockwise directions typically require a large degree of pre-travel rotation (e.g., approaching 15-20°) of the actuator shaft before the rotation is translated into linear movement of the output member, which results in an increased switching/tripping time for the limit switch. While it is possible to reduce this large degree of pre-travel rotation, such reduction of the pre-travel rotation angle is commonly achieved by making the head assembly more complex with more moving parts, such as by having separate cam members and provision for mounting these cam members in different orientations with respect to the actuator shaft and output member to obtain the desired operation. It is thus recognized that head assemblies with such a construction include a large number of moving parts, which increases the cost and complexity of the head assembly and may lead to reliability issues in the field.

It would therefore be desirable to provide a head assembly for a neutral position limit switch require a small degree of pre-travel rotation (e.g., approaching 5°) of the actuator shaft before the rotation is translated into linear movement of the output member, in order to provide a quicker switching/tripping time for the limit switch. It would further be desirable for the head assembly to achieve this reduced degree of pre-travel rotation via a simplified head assembly design with a reduced number of moving parts that would require less time and cost for assembly thereof and that would enhance reliability of the limit switch due to the reduction of moving components therein.

BRIEF DESCRIPTION OF THE INVENTION

In accordance with one aspect of the invention, an operating head for providing actuation in a limit switch includes a housing, a shaft rotatable in clockwise and counter-clockwise directions, a cam member supported on the shaft and that is rotatable in the clockwise and counter-clockwise directions responsive to rotation of the shaft, and a follower actuated by the cam member responsive to rotation of the cam member in the clockwise and counter-clockwise directions, with the follower further including a pivot pin secured to the housing, a lever portion positioned on the pivot pin and pivotable thereabout in opposing directions, and a rolling pin mounted to the lever portion and in contact with the cam member. The operating head also includes an actuator member in contact with the lever portion and that translates linearly in a first direction or a second direction responsive to the pivoting of the lever portion. The rolling pin moves along a profile of the cam member upon rotation of the cam member in the clockwise or counter-clockwise direction so as to cause the lever portion to pivot, with the actuator member linearly translating in the first direction or the second direction responsive to the pivoting of the lever portion.

In accordance with another aspect of the invention, an electrical limit switch includes a switch subassembly having a plurality of fixed electrical terminals and a contact carrier comprising electrical contacts thereon, the contact carrier movable between a plurality of distinct switching positions to selectively shift a location of the electrical contacts to different electrical terminals to make and break different circuits in the switch subassembly. The electrical limit switch also includes an operating head subassembly having a shaft rotatable in clockwise and counter-clockwise directions, a cam member supported on the shaft and that is rotatable in the clockwise and counter-clockwise directions responsive to rotation of the shaft, an actuator member configured to move linearly in a first direction or a second direction responsive to rotation of the cam member in the clockwise or counter-clockwise direction to cause a corresponding movement of the contact carrier, and a follower in contact with each of the cam member and the actuator member to translate rotation of the cam member in the clockwise or counter-clockwise direction into linear movement of the actuator member in the first or second direction, with the follower directly actuating the actuator member.

In accordance with yet another aspect of the invention, an operating head for providing actuation in a limit switch includes a shaft rotatable in clockwise and counter-clockwise directions, a cam member supported on the shaft and that is rotatable in the clockwise and counter-clockwise directions responsive to rotation of the shaft, and an actuator member that moves linearly from a normal position in a first direction or a second direction responsive to rotation of the cam member in the clockwise or counter-clockwise direction, the actuator member movable between a first actuated position and a second actuated position. The operating head also includes a follower in contact with each of the cam member and the actuator member to translate rotation of the cam member in the clockwise or counter-clockwise direction into linear movement of the actuator member in the first or second direction. In operation of the operating head, there is approximately 5° of pre-travel rotation of the shaft to move the actuator member to the first actuated position and the second actuated position.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE INVENTION

Embodiments of the present invention provide a neutral position limit switch having a simplified head assembly with a reduced number of moving parts and that improves reliability. The head assembly is constructed to have an actuator shaft that, upon rotation thereof, causes rotation of a single cam and a corresponding pivoting of a follower based on an interface between the cam and a rolling pin of the follower. Only a small degree of pre-travel rotation (e.g., approaching 5°) of the actuator shaft is required before the cam is sufficiently rotated to cause it to interact with the rolling pin and translate the rotation into linear movement of an output member, thereby causing actuation of the limit switch.

Figure 1:
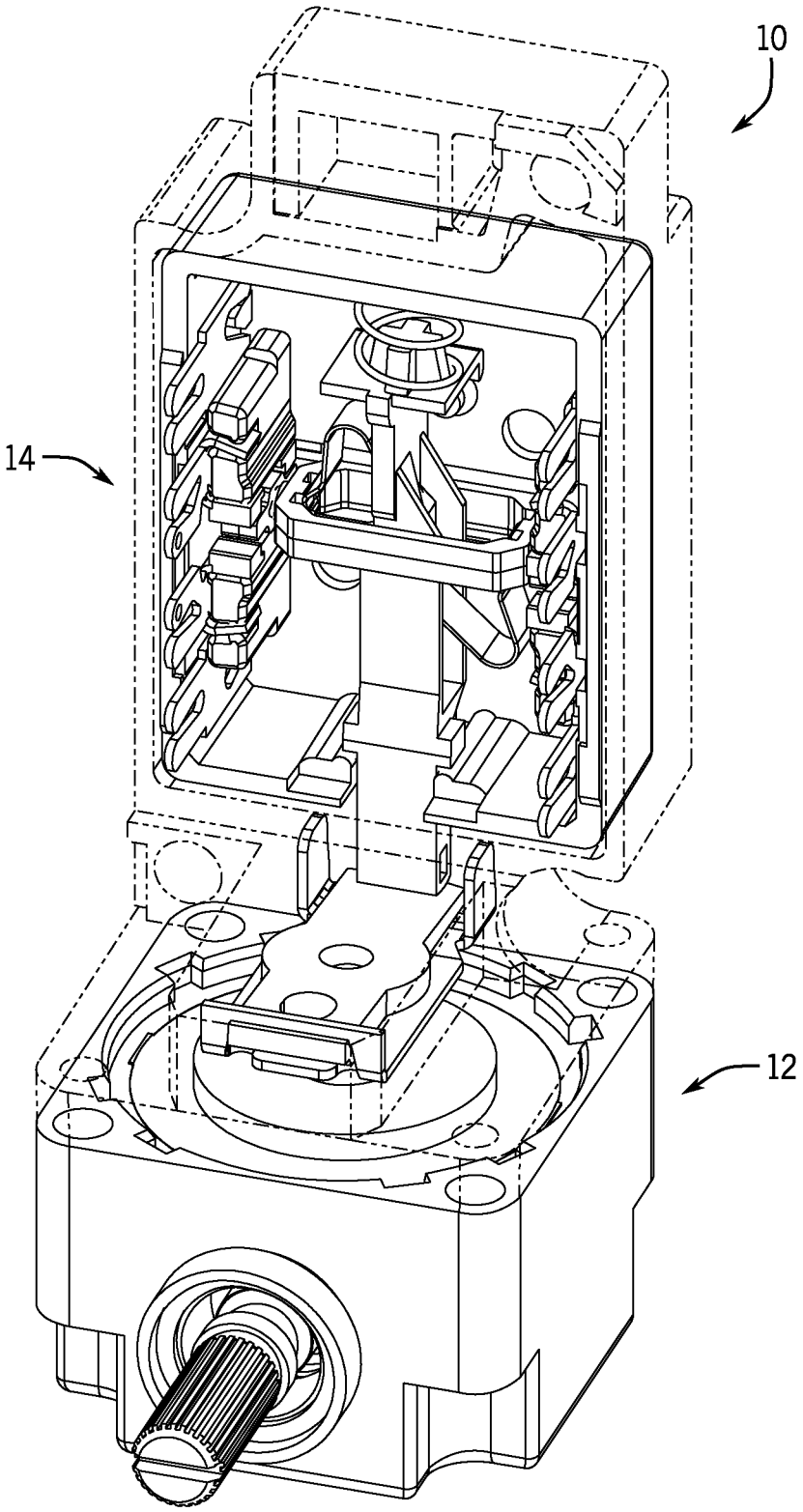
FIG. 1 is a perspective view of a neutral position limit switch, according to an embodiment of the invention.

Referring to FIG. 1, a neutral position limit switch 10 is illustrated according to an embodiment of the present invention. The neutral position limit switch 10 includes an operating head subassembly 12 and a switch subassembly 14. The operating head 12 is held on the switch subassembly by four screws (not shown), one at each corner, and may be separated therefrom by removal of such screws. In operation, the limit switch 10 may be selectively controlled for completing and/or interrupting one or more electrical connections depending upon the position of a displaceable switch-sensing member in switch subassembly 14, as will be explained in greater detail further below.

Figure 2:
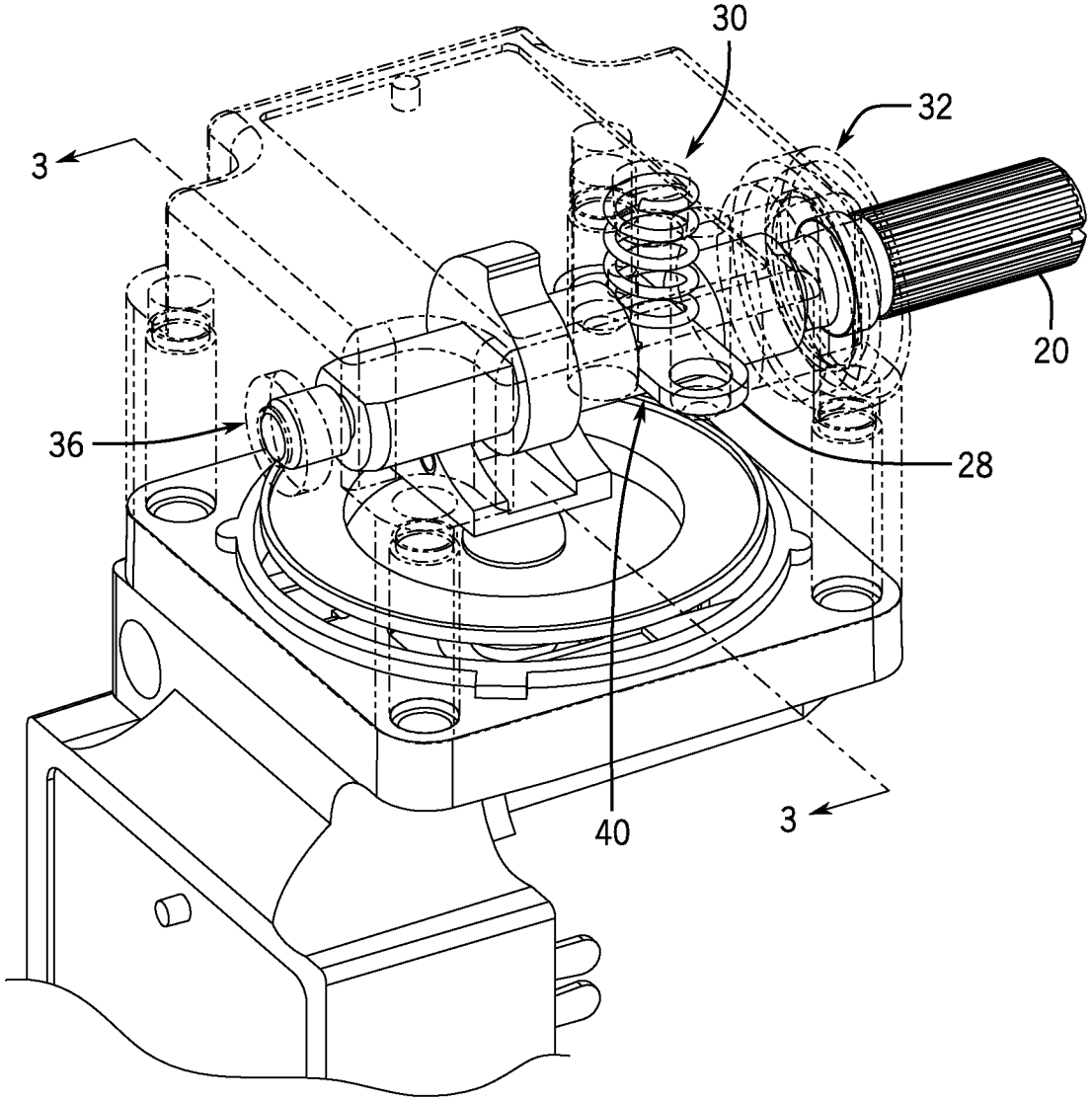
FIG. 2 is a perspective view of an operating head of the neutral position limit switch of FIG. 1 shown in phantom, according to an embodiment of the invention.
Figure 3:
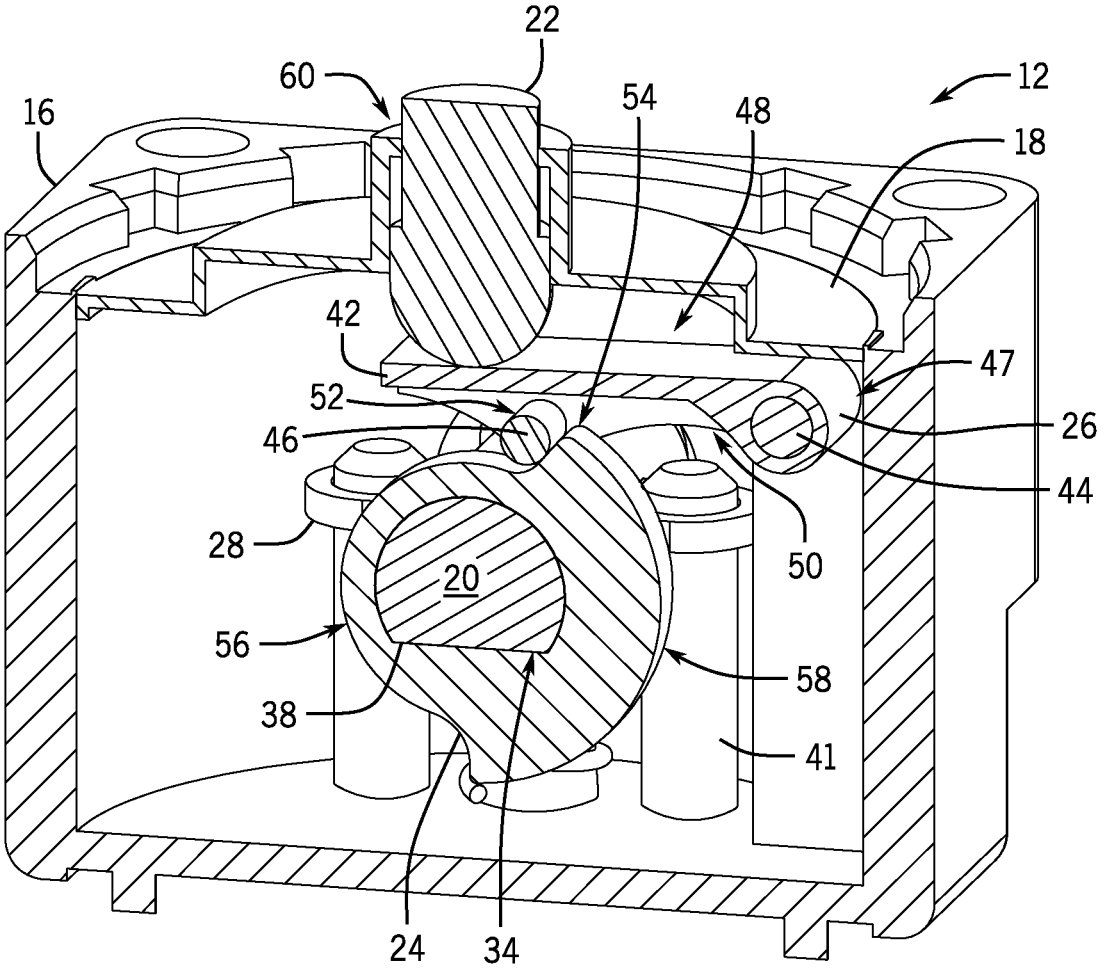
FIG. 3 is a cross-sectional view of the operating head taken along line 3-3 of FIG. 2.

Embodiments of the present invention relate particularly to the mechanisms contained within the operating head 12, and thus FIGS. 2 and 3 show more detailed views of the operating head 12. As shown therein, the operating head 12 is generally constructed to include an outer housing 16, a cap 18, a rotatable shaft 20, an actuator member 22, a cam member 24, a follower 26, a stopper 28, and a return mechanism (e.g., coil spring) 30. The shaft 20 extends from an exterior of housing 16 and through a sleeve bearing 32 into an interior of the housing 16, with the shaft 20 extending through an opening 34 in cam member 24 and being pivotably seated in a mount or sleeve bearing 36 formed in housing 16 opposite sleeve bearing 32. While not shown in FIGS. 2 and 3, it is recognized that neutral position limit switch 10 would include an operating arm that is mounted at an angle on shaft 20 and secured thereon (e.g., by tightening a screw) to provide for rotation of the shaft 20, as known in the art. The operating arm could include a roller for engagement by a moving machine part or the like that causes rotation of the operating arm and a corresponding rotation of the shaft 20.

The shaft 20 is constructed as a generally round cylindrical member and has a half-round portion with a flat drive surface 38 in the area thereof where shaft 20 is seated within cam member 24, such that rotation of shaft 20 imparts rotation to cam member 24. The shaft 20 also includes a notch 40 formed therein to receive stopper 28, with the stopper 28 being seating on a flat surface in notch 40 such that the stopper 28 may be oriented/arranged flush to the shaft 20. The stopper 28 is centered on shaft 20 and is mounted relative thereto via a pair of guide pins 41. The stopper 28 is aligned on guide pins 41 via openings included in stopper 28 on opposing ends thereof, with the stopper 28 linearly translating along guide pins 41 responsive to rotation of shaft 20. Coil spring 30 is positioned adjacent stopper 28 and within notch 40, with one end of coil spring 30 being mounted to an interior surface of housing 16 and the opposite end of coil spring 30 contacting stopper 28. The coil spring 30 functions to bias the stopper 28 and shaft 20 into a neutral position when no rotational force/torque is being applied to shaft 20, as will be explained in greater detail below.

As best shown in FIG. 3, the follower 26 is generally comprised of a lever portion 42, a pivot pin 44, and a rolling pin 46. The pivot pin 44 is affixed to housing 16 and mates with an opening 47 formed in lever portion 42, so as to provide for rotation of the lever portion 42 about the pivot pin 44. The lever portion 42 extends outwardly from the location of pivot pin 44 and is aligned so as to be positioned adjacent to and between cam member 24 and actuator member 22. A first surface 48 of lever portion 42 abuts actuator member 22 and is formed as a generally flat surface, with the surface 48 interacting with actuator member 22 to cause movement thereof upon rotation of the lever portion 42. The rolling pin 46 is secured to lever portion 42 generally adjacent to a second surface 50 thereof that is opposite from first surface 48. The rolling pin 46 is inserted into an opening 52 formed in lever portion 42, with the opening 52 being formed in lever portion 42 at a location that is positioned lengthwise between the location of pivot pin 44 and a location where actuator member 22 abuts lever portion 42. The lever portion 42 is thicker at this location so as to provide for forming of opening 52 therein and accommodation of the rolling pin 46 within opening 52. Rolling pin 46 extends outwardly from opening 52 in lever portion 42 so as to abut cam member 24 and allow for interaction between follower 26 and cam member 24.

As also best shown in FIG. 3, the cam member 24 comprises a disc or plate cam and has a cam profile shaped to include a protrusion 54 sloping from a reduced diameter cam surface 56 to an increased diameter cam surface 58. Shaft 20 is seated within opening 34 of cam member 24 in a manner (e.g., friction fit) such that cam member 24 is secured to shaft 20 at a desired location. The cam member 24 is positioned relative to follower 26 such that the rolling pin 46 of follower 26 floats at a half-point on the sloped protrusion 54 of cam member 24—which corresponds to a neutral position of the operating head 12 and limit switch 10.

Accordingly, rotation of cam member 24 in a clockwise direction causes rolling pin 46 to move downwardly along the sloped protrusion 54 of cam member 24 to the reduced diameter cam surface 56, while rotation of cam member 24 in a counter-clockwise direction causes rolling pin 46 to move upwardly along the sloped protrusion 54 of cam member 24 to the increased diameter cam surface 58. Thus, movement of the lever portion 42 of follower 26 in an upward or downward manner is achieved upon rotation of the cam member 24.

Following from the rotation of cam member 24 in a clockwise or counter-clockwise direction and the corresponding upward or downward movement of the lever portion 42 of follower 26, the actuator member 22 in contact with lever portion 42 is also caused to move from a normal or unbiased position. That is, the actuator member 22 may slide inwardly or outwardly along a linear path based on the movement of follower 26—with the actuator member 22 being movable between fully actuated positioned that can generally be termed as a first actuated position and a second actuated position that each cause a tripping of the limit switch 10. According to an exemplary embodiment, the actuator member 22 is positioned so as to be adjacent end of lever portion 42 and so as to be aligned off-of-axis about which follower member 26 is rotated (i.e., off of the central axis of force rotation of shaft 20). This positioning of actuator member 22 off of the central axis of force rotation lowers the level of torque required to be applied to rotate shaft 20 and reduces forces transmitted between the cam member 24 and the rolling pin 46.

Figure 4:
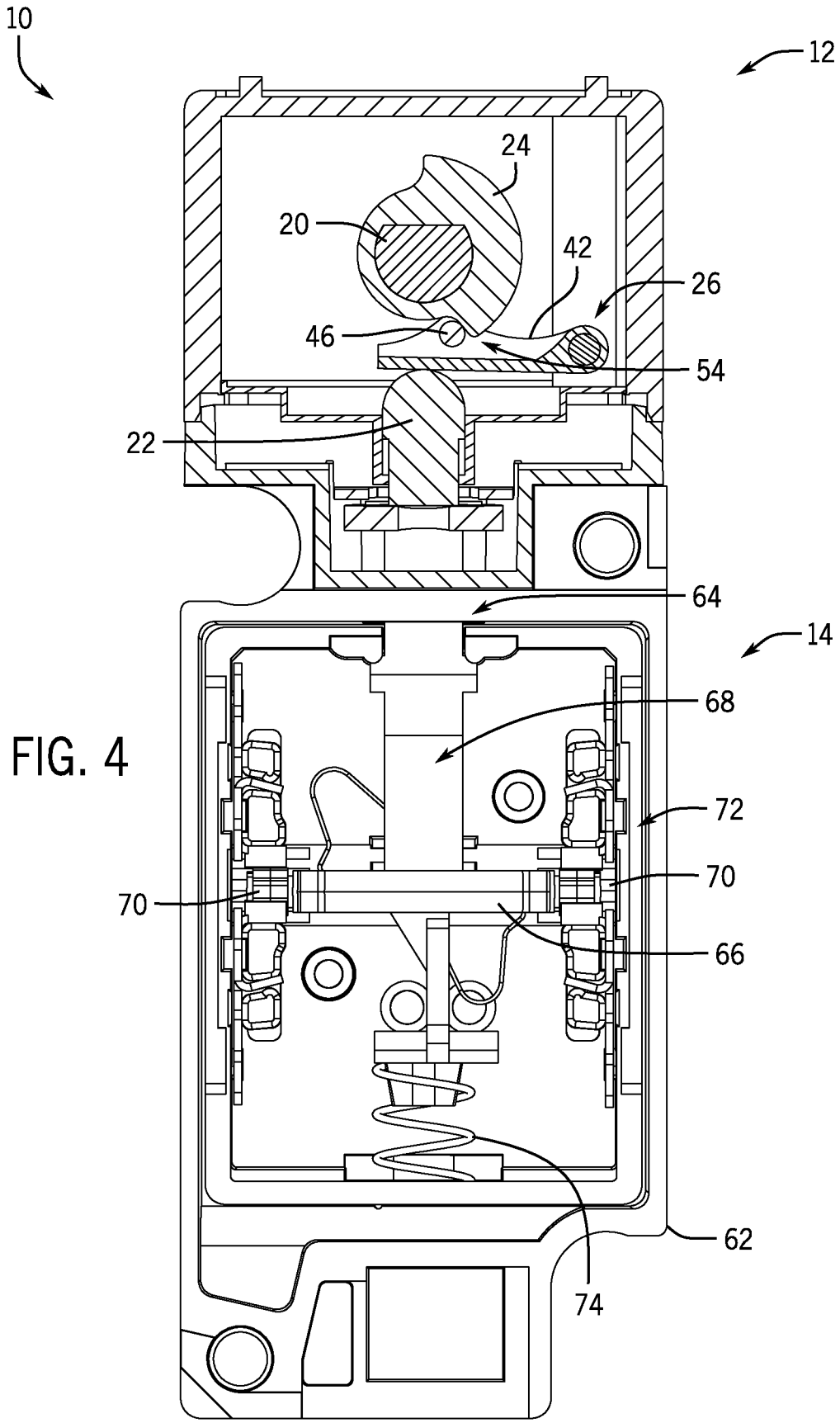
FIG. 4 is a schematic diagram of the operating head of FIG. 2 showing the operating head in a normal condition or position.

As actuator member 22 is moved by follower 26, the actuator member 22 slides along/within an opening 60 in cap 18 to provide linear actuation to components of switch subassembly 14, with the cap 18 providing a guide for the actuator member 22. As shown in FIG. 4, the actuator member 22 extends into a switch housing 62 of switch subassembly 14 (via a bushing 64 formed in switch housing 62) and causes relative movement of a contact carrier 66 thereof. More specifically, according to an exemplary embodiment, actuator member 22 abuts against a plunger 68 in switch subassembly 14 that is aligned therewith in order to cause linear movement of the plunger 68, which in turn causes relative movement of contact carrier 66. The contact carrier 66 shifts a location of contacts 70 in the switch subassembly 14 to different terminals 72 to either make or break different circuits in the switch subassembly 14. That is, the contact carrier 66 shifts a location of contacts 70 to different terminals 72 based on the inward or outward movement of actuator member 22 to the first and second actuated positions, so as to either make or break different circuits in the two-step switch of switch subassembly 14. A compression spring 74 is provided between a bottom side of switch housing 62 and the bottom of the plunger 68 to urge the plunger 68 and actuator member 22 and back to a normal/neutral position.

Figure 5:
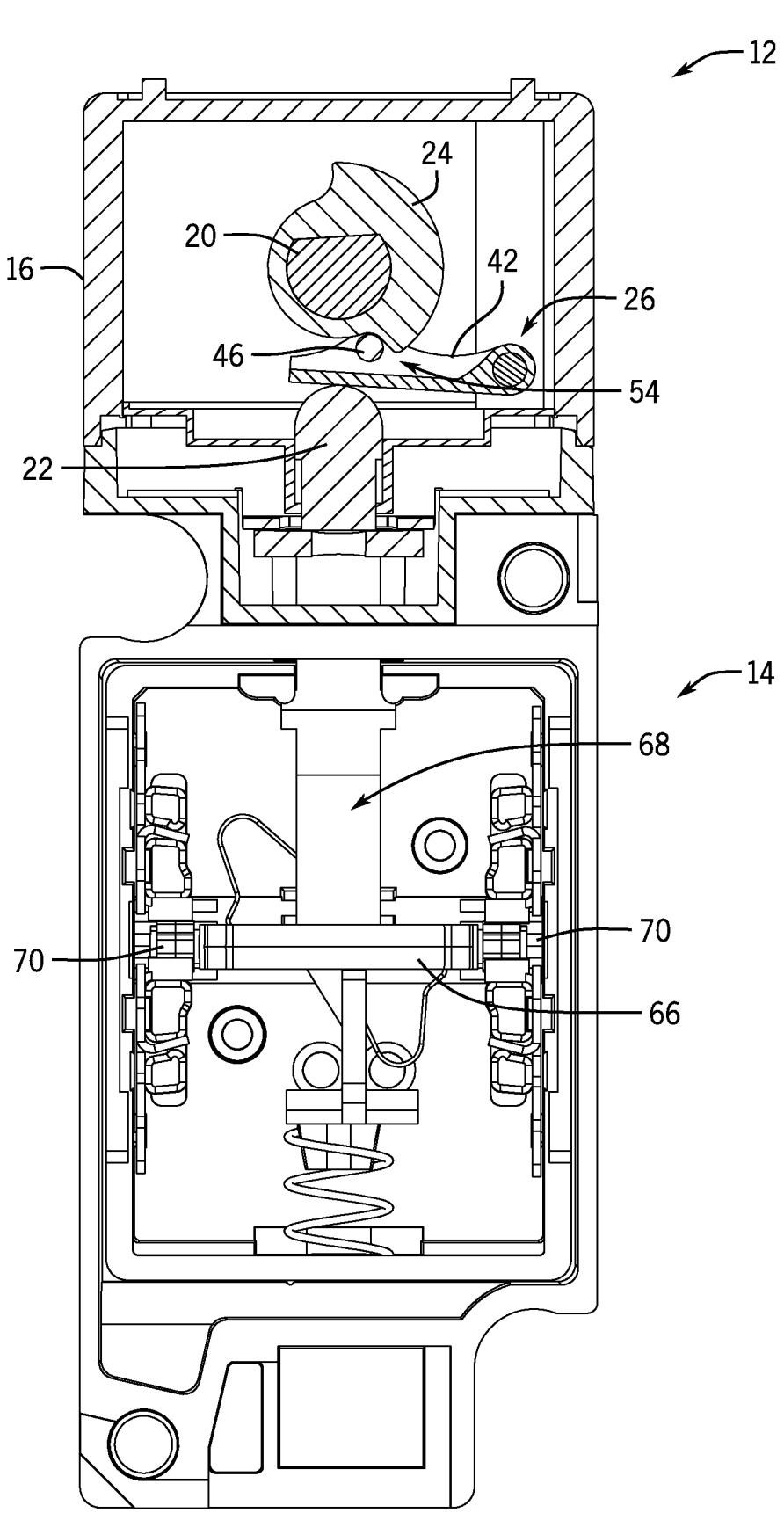
FIG. 5 is a schematic diagram of the operating head of FIG. 2 showing the operating head upon rotation of the rotatable shaft thereof in a clockwise direction.
Figure 6:
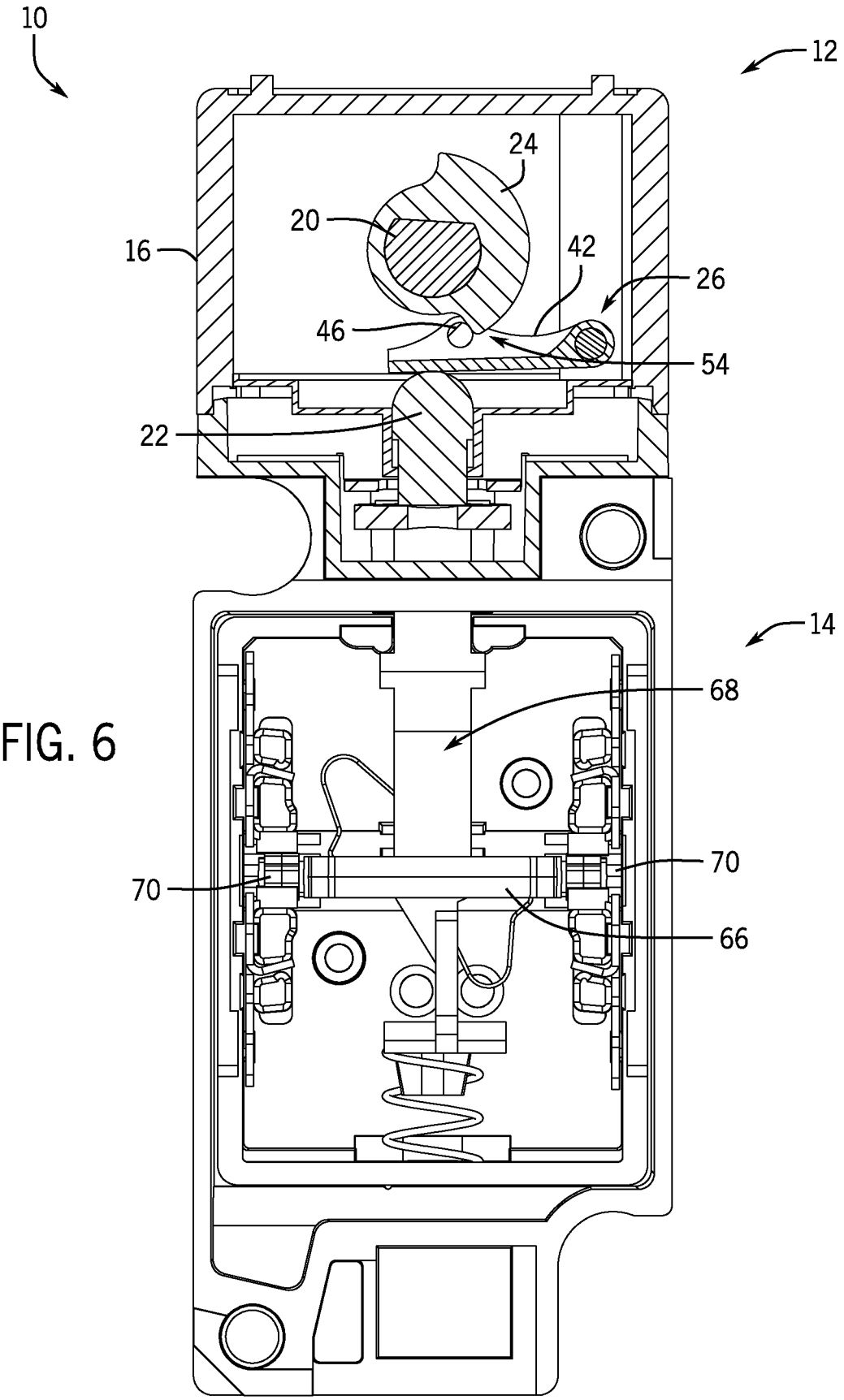
FIG. 6 is a schematic diagram of the operating head of FIG. 2 showing the operating head upon rotation of the rotatable shaft thereof in a counter-clockwise direction.

Referring still to FIG. 4 and now also to FIGS. 5 and 6, illustration of the functioning of operating head 12 at a normal/neutral position and upon rotation of the shaft 20 in a clockwise direction and a counter-clockwise direction is shown, respectively, along with interaction of the operating head 12 with switch subassembly 14, according to an embodiment of the invention. As first shown in FIG. 4, the operating head 12 is at a normal/neutral position where the cam member 24 is in a non-rotated position such that the rolling pin 46 of follower 26 is floating at a half-point on the sloped protrusion 54 of cam member 24. Accordingly, follower 26 (i.e., lever portion 42 thereof) is also at a normal/neutral position and the actuator member 22 is also at rest at a normal/neutral position. The contact carrier 66 of switch subassembly is thus in an unbiased position, with the contacts 70 thereon being located accordingly to make/break circuits associated with the unbiased position.

Referring to FIG. 5, the shaft 20 of operating head 12 is rotated in a clockwise direction. Upon rotation of the shaft 20, the cam member 24 is rotated and starts to interact with rolling pin 46, thereby initiating pivoting of follower 26 and translation of actuator member 22—with rotation of the shaft 20 at or past a minimum rotation amount, such as past approximately 5° of pre-travel (i.e., 5° of pre-travel +/−2°), causing cam member 24 to rotate by an amount that causes a linear movement of actuator member 22 to the first actuated position to trip limit switch 10. Thus, upon rotation of the shaft 20 in the clockwise direction past this minimum rotation amount, the cam member 24 is rotated so as to cause the rolling pin 46 of follower 26 to move fully down the sloped protrusion 54 of cam member 24 to the reduced diameter cam surface. This causes lever portion 42 of follower 26 to move/rotate back toward cam member 24 and the actuator member 22 to correspondingly retract back into housing 16 of operating head 12 a pre-determined linear distance, i.e., to the first actuated position. The retracting of actuator member 22 to the first actuated position causes plunger 68 of switch subassembly to move contact carrier 66 to a first biased position, with the contacts 70 thereon being located accordingly to make/break circuits associated with the first biased position.

Referring to FIG. 6, the shaft 20 of operating head 12 is rotated in a counter-clockwise direction. Upon rotation of the shaft 20, the cam member 24 is rotated and starts to interact with rolling pin 46, thereby initiating pivoting of follower 26 and translation of actuator member 22—with rotation of the shaft 20 at or past a minimum rotation amount (e.g., past approximately 5° of pre-travel), causing cam member 24 to rotate by an amount that causes a linear movement of actuator member 22 to the second actuated position to trip limit switch 10. Thus, upon rotation of the shaft 20 in the counter-clockwise direction past this minimum rotation amount, the cam member 24 is rotated so as to cause the rolling pin 46 of follower 26 to move fully up the sloped protrusion 54 of cam member 24 to the increased diameter cam surface. This causes lever portion 42 of follower 26 to move/rotate out and away from cam member 24 and the actuator member 22 to correspondingly extend further outward from housing 16 of operating head 12 a pre-determined linear distance, i.e., to the second actuated position. The extending of actuator member 22 to the second actuated position causes plunger 68 of switch subassembly to move contact carrier 66 to a second biased position, with the contacts 70 thereon being located accordingly to make/break circuits associated with the second biased position.

With regard to movement of the actuator member 22 caused by follower 26 upon rotation of cam member 24 past the designated pre-travel amount, positioning of the actuator member 22 will remain at its actuated position for another 85°-90° of post-travel of the cam member 24 in the same direction or until torque/rotational force on the shaft 20 and cam member 24 is terminated and the cam member 24 and follower 26 are returned to their normal/neutral position. For returning the cam member 24 and follower 26 to their normal/neutral position, the coil spring 30 of operating head 12 exerts a force on stopper 28 and causes stopper 28 to slide on guide pins 41 and exert force on shaft 20, which in turn urges shaft 20 back toward its normal, non-rotated position—with the cam member 24 and follower 26 also thus returning to their normal/neutral position. The returning of cam member 24 and follower 26 to their normal/neutral position thus also returns actuator member 22 to its at rest, normal/neutral position, such that the contact carrier 66 of switch subassembly 14 is at its unbiased position. This completes a cycle of operation for the limit switch 10.

The construction of operating head 12 and the arrangement of the components therein provides for a number of benefits in the present design. First, the positioning of rolling pin 46 at a half-point on the sloped protrusion 54 of cam member 24 when in a neutral position provides a limit switch 10 with only a small amount of pre-travel rotation (e.g., approximately 5°) of the actuator shaft 20 required before the cam member 24 is sufficiently rotated to cause tripping of the limit switch 10, with interaction of the cam member 24 and rolling pin 46 of follower 26 (and linear movement of the actuator member 22) occurring across this pre-travel range (i.e., from) 0°-5°. This small amount of required pre-travel allows for a quicker switching/tripping of the switch subassembly 14 in the limit switch 10. Additionally, the use of rolling pin 46 in follower 26—and its interaction with cam member 24—reduces friction forces between the follower 26 and the cam member 24 when the cam member 24 is rotated. This reduction of friction forces—along with the shape and pivoting nature of follower 26 in general—allows for greater leeway in the range of the cam pressure angle (e.g., between 30° and 45°) that may be acceptable for interaction between the follower 26 and the cam member 24. Still further, positioning of the actuator member 22 so as to be aligned off-of-axis about which follower member 26 is rotated (i.e., off of the central axis of force rotation) lowers the level of torque required to be applied to rotate shaft 20 and reduces forces transmitted between the cam member 24 and the rolling pin 46. The reduced level of torque necessary to rotate cam member 24 is desirable for reducing forces in the operating head 12 and increasing longevity of the operating head 12.

Beneficially, embodiments of the invention thus provide a neutral position limit switch with an operating head subassembly having a simplified design with a reduced number of moving parts that requires less time and cost for assembly thereof and that enhances reliability of the limit switch due to the reduction of moving components therein. The operating head subassembly requires only a small degree of pre-travel rotation (e.g., approaching 5°) of the actuator shaft before the rotation is sufficient to linearly translate the output member to a fully actuated position, in order to provide a quicker switching/tripping time for the limit switch. Additionally, the construction of the operating head subassembly provides for required functioning thereof in a confined, small space, i.e., a compact operating head subassembly. Thus, the benefit of a simplified design with a reduced number of moving parts that enhances reliability of the limit switch is achieved without having to increase the outer boundary/size of the operating head subassembly.

Therefore, according to one embodiment of the present invention, an operating head for providing actuation in a limit switch includes a housing, a shaft rotatable in clockwise and counter-clockwise directions, a cam member supported on the shaft and that is rotatable in the clockwise and counter-clockwise directions responsive to rotation of the shaft, and a follower actuated by the cam member responsive to rotation of the cam member in the clockwise and counter-clockwise directions, with the follower further including a pivot pin secured to the housing, a lever portion positioned on the pivot pin and pivotable thereabout in opposing directions, and a rolling pin mounted to the lever portion and in contact with the cam member. The operating head also includes an actuator member in contact with the lever portion and that translates linearly in a first direction or a second direction responsive to the pivoting of the lever portion. The rolling pin moves along a profile of the cam member upon rotation of the cam member in the clockwise or counter-clockwise direction so as to cause the lever portion to pivot, with the actuator member linearly translating in the first direction or the second direction responsive to the pivoting of the lever portion.

According to another embodiment of the present invention, an electrical limit switch includes a switch subassembly having a plurality of fixed electrical terminals and a contact carrier comprising electrical contacts thereon, the contact carrier movable between a plurality of distinct switching positions to selectively shift a location of the electrical contacts to different electrical terminals to make and break different circuits in the switch subassembly. The electrical limit switch also includes an operating head subassembly having a shaft rotatable in clockwise and counter-clockwise directions, a cam member supported on the shaft and that is rotatable in the clockwise and counter-clockwise directions responsive to rotation of the shaft, an actuator member configured to move linearly in a first direction or a second direction responsive to rotation of the cam member in the clockwise or counter-clockwise direction to cause a corresponding movement of the contact carrier, and a follower in contact with each of the cam member and the actuator member to translate rotation of the cam member in the clockwise or counter-clockwise direction into linear movement of the actuator member in the first or second direction, with the follower directly actuating the actuator member.

According to yet another embodiment of the present invention, an operating head for providing actuation in a limit switch includes a shaft rotatable in clockwise and counter-clockwise directions, a cam member supported on the shaft and that is rotatable in the clockwise and counter-clockwise directions responsive to rotation of the shaft, and an actuator member that moves linearly from a normal position in a first direction or a second direction responsive to rotation of the cam member in the clockwise or counter-clockwise direction, the actuator member movable between a first actuated position and a second actuated position. The operating head also includes a follower in contact with each of the cam member and the actuator member to translate rotation of the cam member in the clockwise or counter-clockwise direction into linear movement of the actuator member in the first or second direction. In operation of the operating head, there is approximately 5° of pre-travel rotation of the shaft to move the actuator member to the first actuated position and the second actuated position.

The present invention has been described in terms of the preferred embodiment, and it is recognized that equivalents, alternatives, and modifications, aside from those expressly stated, are possible and within the scope of the appending claims.

What is claimed is:

1. An operating head for providing actuation in a limit switch, the operating head comprising:

a housing;

a shaft rotatable in clockwise and counter-clockwise directions;

a cam member supported on the shaft and that is rotatable in the clockwise and counter-clockwise directions responsive to rotation of the shaft;

a follower actuated by the cam member responsive to rotation of the cam member in the clockwise and counter-clockwise directions, the follower comprising:

a pivot pin directly affixed to the housing;

a lever portion comprising an opening positioned on the pivot pin, the lever portion configured to rotate in two directions about the pivot pin; and a rolling pin inserted in an opening in the lever portion and extending outward from the opening in the lever portion, the rolling pin being in contact with the cam member; and an actuator member in contact with the lever portion and that translates linearly in a first direction or a second direction responsive to the pivoting of the lever portion;

wherein the rolling pin moves along a profile of the cam member upon rotation of the cam member in the clockwise or counter-clockwise direction so as to cause the lever portion to pivot, with the actuator member linearly translating in the first direction or the second direction responsive to the pivoting of the lever portion.

2. The operating head of claim 1 wherein the profile of the cam member comprises a protrusion sloping from a reduced diameter cam surface to an increased diameter cam surface, and wherein the rolling pin floats at a half-point on the sloped protrusion when the operating head is at a normal operating position; and wherein, when the operating head is at the normal operating position, the cam member is in a non-rotated position.

3. The operating head of claim 2 wherein the rolling pin moves downwardly along the sloped protrusion to the reduced diameter cam surface when the cam member is rotated in the clockwise direction, thereby causing the lever portion to pivot towards the cam member and the actuator member to linearly translate in the first direction.

4. The operating head of claim 2 wherein the rolling pin moves upwardly along the sloped protrusion to the increased diameter cam surface when the cam member is rotated in the counter-clockwise direction, thereby causing the lever portion to pivot away from the cam member and the actuator member to linearly translate in the second direction.

5. The operating head of claim 2 wherein the rolling pin moves from the half-point on the sloped protrusion to the decreased diameter cam surface or the increased diameter cam surface upon 5° of pre-travel rotation of the shaft in the clockwise or counter-clockwise direction, so as to move the actuator member to a first position or a second position.

6. The operating head of claim 5 wherein, after the 5° of pre-travel rotation of the shaft to move the rolling pin to the decreased diameter cam surface or the increased diameter cam surface, the rolling pin moves along the decreased diameter cam surface or the increased diameter cam surface for another 85°-90° of post-travel rotation of the shaft in the same direction.

7. The operating head of claim 1 wherein the actuator member is positioned so as to be aligned off-of-axis about which the follower member is rotated.

8. The operating head of claim 1 wherein the shaft includes a notch formed therein, and wherein the operating head further comprises:

a stopper positioned in the notch so as to be in contact with the shaft; and a coil spring abutting the stopper on one end and abutting the housing on an opposing end;

wherein the coil spring functions to bias the stopper and shaft into a normal operating position when no rotational force is applied to the shaft.

9. The operating head of claim 1 wherein, in moving along the profile of the cam member, the rolling pin rolls along the profile so as to reduce friction between the follower and the cam member.

10. An electrical limit switch comprising:

a switch subassembly including:

a plurality of fixed electrical terminals; and a contact carrier comprising electrical contacts thereon, the contact carrier movable between a plurality of distinct switching positions to selectively shift a location of the electrical contacts to different electrical terminals to make and break different circuits in the switch subassembly; and an operating head subassembly including:

a shaft rotatable in clockwise and counter-clockwise directions;

one cam member supported on the shaft, the one cam member being rotatable in the clockwise and counter-clockwise directions responsive to rotation of the shaft;

an actuator member configured to move linearly in a first direction or a second direction responsive to rotation of the one cam member in the clockwise or counter-clockwise direction, with movement of the actuator member causing a corresponding movement of the contact carrier; and a follower comprising: a lever portion; and a rolling pin extending outward from an opening in the lever portion, the rolling pin being in contact with the one cam member, and the follower being in contact with the actuator member to translate rotation of the one cam member in the clockwise or counter-clockwise direction into linear movement of the actuator member in the first or second direction, with the follower directly actuating the actuator member.

11. The electrical limit switch of claim 10 wherein the follower further comprises: a pivot pin secured to a housing of the operating head subassembly, and wherein the lever portion positioned is on the pivot pin and is pivotable thereabout in opposing directions, the lever portion in contact with the actuator member so as to enable movement thereof; and wherein the rolling pin moves along a profile of the one cam member upon rotation of the one cam member in the clockwise or counter-clockwise direction so as to cause the lever portion to pivot, with the actuator member linearly translating in the first direction or the second direction responsive to the pivoting of the lever portion.

12. The electrical limit switch of claim 11 wherein the profile of the one cam member comprises a protrusion sloping from a reduced diameter cam surface to an increased diameter cam surface, and wherein the rolling pin floats at a half-point on the sloped protrusion when the operating head is at a normal operating position.

13. The electrical limit switch of claim 12 wherein the rolling pin moves downwardly along the sloped protrusion to the reduced diameter cam surface when the one cam member is rotated in the clockwise direction, thereby causing the lever portion to pivot towards the one cam member and the actuator member to linearly translate in the first direction.

14. The electrical limit switch of claim 12 wherein the rolling pin moves upwardly along the sloped protrusion to the increased diameter cam surface when the one cam member is rotated in the counter-clockwise direction, thereby causing the lever portion to pivot away from the one cam member and the actuator member to linearly translate in the second direction.

15. The electrical limit switch of claim 12 wherein the rolling pin moves from the half-point on the sloped protrusion to the decreased diameter cam surface or the increased diameter cam surface upon 5° of pre-travel rotation of the shaft in the clockwise or counter-clockwise direction, so as to cause movement of the contact carrier to one of the plurality of distinct switching positions.

16. The electrical limit switch of claim 11 wherein the actuator member is positioned so as to be adjacent an end of the lever portion and off-center from a central force axis about which the follower is rotated.

17. The electrical limit switch of claim 10 wherein the switch subassembly further comprises a plunger aligned with the actuator member and configured to move linearly responsive to a force applied thereto by the actuator member, the plunger abutting the contact carrier to cause movement thereof.

18. An operating head for providing actuation in a limit switch, the operating head comprising:

a shaft rotatable in clockwise and counter-clockwise directions;

a cam member supported on the shaft and that is rotatable in the clockwise and counter-clockwise directions responsive to rotation of the shaft;

an actuator member that moves linearly from a normal position in a first direction or a second direction responsive to rotation of the cam member in the clockwise or counter-clockwise direction, the actuator member movable between a first actuated position and a second actuated position; and a follower in contact with the cam member and the actuator member to translate rotation of the cam member in the clockwise or counter-clockwise direction into linear movement of the actuator member in the first or second direction, the follower comprising: a lever portion; and a rolling pin extending outward from an opening in the lever portion, the rolling pin being in contact with the cam member.

19. The operating head of claim 18 wherein the follower further comprises:

a pivot pin secured to a housing of the operating head, and wherein the lever portion is positioned on the pivot pin and is pivotable thereabout in opposing directions; and wherein the rolling pin moves along a profile of the cam member upon rotation of the cam member in the clockwise or counter-clockwise direction so as to cause the lever portion to pivot, with the actuator member linearly translating in the first direction or the second direction responsive to the pivoting of the lever portion.

20. The operating head of claim 18 wherein the actuator member is positioned so as to be aligned off of an axis about which the follower member is rotated.

21. The operating head of claim 18, wherein upon approximately 5° of pre-travel rotation of the shaft, the cam member is sufficiently rotated such that the actuator member moves to the first actuated position or the second actuated position.

22. An operating head comprising:

a shaft rotatable in clockwise and counter-clockwise directions;

a follower comprising: a lever portion; and a rolling pin that extends from an opening in the lever portion;

a cam member rotatable in the clockwise and counter-clockwise directions responsive to rotation of the shaft, the cam member comprising a cam surface, the cam surface comprising: a reduced diameter cam surface, an increased diameter cam surface, and a sloped region between the reduced diameter cam surface and the increased diameter cam surface; and an actuator member that moves linearly from a normal position in a first direction or a second direction responsive to rotation of the cam member in the clockwise direction or counter-clockwise direction, wherein the rolling pin rests on the sloped region without touching the reduced diameter cam surface or the increased diameter cam surface when the operating head is at a normal operating position, and the operating head is at the normal operating position when no rotational force is applied to the shaft.

* * * * *